United States Patent [19]

Frikker

[11] Patent Number: 4,496,294

[45] Date of Patent: Jan. 29, 1985

[54] DIAPHRAGM PUMP

[75] Inventor: Jozsef Frikker, Dreieich, Fed. Rep. of Germany

[73] Assignee: Champion Spark Plug Company, Toledo, Ohio

[21] Appl. No.: 451,981

[22] Filed: Dec. 21, 1982

[30] Foreign Application Priority Data

Dec. 22, 1981 [GB] United Kingdom ..... 8138785

[51] Int. Cl.[3] ..... F04B 43/06; F01L 25/02

[52] U.S. Cl. ..... 417/393; 91/306; 91/313; 91/329

[58] Field of Search ..... 417/393, 395, 531; 91/305, 306, 313, 329, 343, 152, 153

[56] References Cited

U.S. PATENT DOCUMENTS

| | | | |
|---|---|---|---|
| 2,625,886 | 1/1953 | Browne | 417/390 |
| 2,780,177 | 2/1957 | Hoenecke | 91/306 |
| 2,866,415 | 12/1958 | Montelius | 417/345 |
| 3,032,019 | 5/1962 | Oishei et al. | 91/7 |
| 3,192,865 | 7/1965 | Klempay | 417/393 |
| 3,260,212 | 7/1966 | Johnson | 417/360 |
| 3,312,172 | 4/1967 | Harklau et al. | 417/393 |
| 3,349,995 | 10/1967 | Sheesley | 417/225 |
| 3,652,187 | 3/1972 | Loeffler et al. | 417/393 |
| 3,720,137 | 3/1973 | Landherr et al. | 91/279 |
| 3,791,768 | 2/1974 | Wanner | 417/393 |
| 3,838,946 | 10/1974 | Schall | 417/395 |
| 3,927,601 | 12/1975 | Van de Moortele | 91/329 |
| 4,019,838 | 4/1977 | Fluck | 417/393 |
| 4,123,204 | 10/1978 | Scholle | 417/393 |
| 4,289,063 | 9/1981 | Nakamura | 91/306 |
| 4,406,596 | 9/1983 | Budde | 417/393 |

FOREIGN PATENT DOCUMENTS

| | | | |
|---|---|---|---|
| 175243 | 5/1961 | Sweden | 417/393 |
| 1112507 | 5/1968 | United Kingdom . | |

*Primary Examiner*—Leonard E. Smith
*Assistant Examiner*—Jane E. Obee
*Attorney, Agent, or Firm*—Oliver E. Todd, Jr.; Richard D. Emch

[57] ABSTRACT

The present invention provides for an improved diaphragm pump having two material pumping chambers. The material pumping chambers are operated by two working fluid chambers which are separated from the material pumping chambers by two diaphragms. The diaphragms are interconnected to provide that the two material pumping chambers alternatively receive and discharge the material to be pumped. A control valve controls the stroke reversal of the improved diaphragm pump. The control valve is actuated by the pressurized working fluid which is being discharged from a pressurized fluid chamber. Further valving provides for a portion of the pressurized working fluid being discharged from a pressurized fluid chamber to be reused and introduced into the exhausted fluid chamber to initiate expansion of the exhausted fluid chamber. The pre-pressurization of the exhausted fluid chamber reduces the amount of source air required at the beginning of the stroke.

9 Claims, 11 Drawing Figures

DIAPHRAGM PUMP

BACKGROUND OF THE INVENTION

The present invention relates to an improved diaphragm pump. Diaphragm pumps are well-known and enjoy wide-spread use in many applications throughout industry. It has been observed that many of the current diaphragm pumps have encountered problems with material pulsation at the output side of the pumps, especially when the pump is operated at low pressure. Other operational problems have been commonly encountered with many of the current diaphragm pumps such as : a tendency to accumulate a build up of ice at the exhaust port during prolonged use, high operating noise, and inlet and discharge valves which have a tendency to stick in one position after a prolonged shut down.

Many dipahragm pumps of which the applicant is aware generally incorporate some form of mechanical device to move the material inlet valves and the material discharge valves. Many of the pumps use a separate spring loaded valve for individually controlling each inlet port and discharge port for each material pumping chamber found in the diaphragm pump. Other pumps, for example, the pump disclosed in the Harklau et al. patent (U.S. Pat. No. 3,312,172) disclose the use of a single double-acting inlet valve to supply two material chambers and a single double-acting discharge valve to discharge material from the two material chambers. The valves of Harklau et al., however, still require a mechanical piston to move the valve members. The Van de Moortele patent (U.S. Pat. No. 3,927,601) also discloses the use of a double-acting inlet valve to supply material to two material chambers. However, the inlet valve disclosed by Van de Moortele is mechanically actuated by contact with the diaphragm. The present invention endeavors to eliminate the need for mechanical motivation or triggering to actuate its alternating inlet valve and alternating discharge valve by utilizing the pressure differential between the two material fluid chambers of the double diaphragm pump to actuate the inlet valve and the discharge valve. Therefore, the need for mechanical actuation is eliminated and the potential for encountering the stuck valve problems which have plagued past designs of diaphragm pumps is reduced.

The present invention further includes a control valve which is used to reverse the stroke of the pump. The control valve is actuated by the pressurized working fluid, usually compressed air, which is being discharged from a pressurized fluid chamber. The valve system of the present invention further includes two pilot valves which initiate the reversal of the control valve and also direct a portion of the pressurized working fluid into the exhausted fluid chamber to begin expansion of the exhausted fluid chamber as the working fluid is being discharged from the pressurized fluid chamber. Thus, the working fluid being discharged from the pressurized fluid chamber is used in a dual function: to initiate actuation of the reverse stroke of the pump; and to begin pressurization and expansion of the exhausted fluid chamber. Such use of the pressurized fluid as it is discharged therefore reduces the working fluid consumption of the diaphragm pump and reduces the exhaust air, thereby, reducing the potential icing at the exhaust outlet and the noise level of the pump.

It is an object of the invention to provide an improved diaphragm pump having a reduced tendency of material pulsation.

A further object of the invention is to reduce inefficiencies caused by sticking material inlet valves and sticking material discharge valves.

Yet a further object of the invention is to reduce operating noise of the diaphragm pump.

A further object of the invention is to reduce the tendency of the diaphragm pump to ice up at the exhaust ports.

And yet a further object of the invention is to improve the operating efficiency and decrease the consumption of compressed air employed by the diaphragm pump.

SUMMARY OF THE INVENTION

The present invention relates to an improved diaphragm pump having a housing defining two chambers. A diaphragm membrane is secured within each chamber thereby dividing each chamber into a fluid chamber for receiving working fluid and a material chamber for receiving material to be pumped. The diaphragms are rigidly interconnected to alternate between a forward stroke in which working fluid under pressure is injected into the first fluid chamber to pump material from the first material chamber and working fluid is discharged from the second fluid chamber to draw material to be pumped into the second material chamber and a reverse stroke in which the working fluid under pressure is injected into the second fluid chamber to pump material from the second material chamber and working fluid is discharged from the first fluid chamber to draw material to be pumped into the first material chamber.

The pump housing also includes two pilot valves positioned between and in communication with the two fluid chambers. The pilot valves are normally in the closed position so that the first and second fluid chambers are sealed and isolated. Upon actuation, each of the pilot valves will move from its normally closed position to an open position, thereby directing working fluid under pressure from the fluid chamber under pressure to the exhausted fluid chamber to begin expansion of the exhausted fluid chamber and also to direct a burst of working fluid under pressure from the fluid chamber under pressure to a control valve to initiate reversal of the stroke of the pump.

The burst of working fluid to the control valve moves the control valve into a partially actuated position in which the control valve receives further working fluid being discharged under pressure from the fluid chamber under pressure and the discharged working fluid received by the partially actuated control valve completes the actuation of the control valve to completely reverse the stroke of the pump. The use of the discharged working fluid under pressure to move the pilot valve to complete actuation and reversal of the stroke of the pump provides for a very rapid reversal of the pump stroke which in turn acts to reduce pulsation in the pumped material. In practice, the two pilot valves are positioned in opposed directions in the housing so that the first pilot valve actuates the reverse stroke and the second pilot valve actuates the forward stroke.

Actuation of each of the pilot valves causes the working fluid to be directed from the fluid chamber under pressure directly into the exhausted fluid chamber to start the expansion of the exhausted chamber. Further, actuation of each of the pilot valves will cause a burst of the working fluid under pressure to be directed to the control valve for partially actuating the reversal of the stroke of the pump. Each pilot valve has a plug valve that normally seals the pressurized fluid chamber and a check valve that normally seals the exhausted fluid chamber. Displacement of the pilot valve to open the plug valve directs working fluid under pressure to the control valve to partially actuate reversal of the stroke and also to direct working fluid under pressure to the check valve, thereby opening the check valve and admitting the working fluid under pressure into the exhausted fluid chamber. This improved valve structure differs substantially from many existing mechanical diaphragm pumps in which the working fluid, after initiating the reversal of the pump, simply discharges from the pump and is lost. By supplying a portion of the working fluid under pressure to the exhausted fluid chamber, the present invention improves the operating efficiency and decreases the comsumption of compressed air. Further the present invention reduces the volume of discharged air thereby reducing the potential for icing at the exhaust ports.

The control valve includes a pair of opposed cylinders and a pair of opposed pistons, each contained within one of the opposed cylinders. The opposed pistons are interconnected by a rod. The rod includes a plug that is selectively displaced to admit the working fluid under pressure from the supply source to either the first fluid chamber of the second fluid chamber. Each cylinder is in communication with a respective pilot valve through a pilot conduit. As each pilot valve is actuated, the pilot valve releases a burst of working fluid under pressure through the pilot conduit to the piston side of its respective cylinder. The burst of working fluid partially displaces the control valve and initiates the reversal of the stroke of the pump. The control valve is then completely displaced by the pressures exerted on the opposed piston by the working fluid being discharged under pressure into the rod side of the opposed cylinder. This combined action by the working fluid under pressure on the pilot valve greatly increases the speed of stroke reversal and enables rapid stroke reversal to take place even when the working fluid is supplied at a line pressure as low as 1 BAR. This is a great improvement over current control valves that work by pilot air with no assistance from the exhausting air during reversal. If the line pressure of the working fluid is too low, the speed of reversal of most current control valves will be very slow, thus creating problems with material pulsation.

The present invention further includes a single material inlet port and a single material discharge port in communication with the first and second material chambers. The single material inlet port has an alternating inlet valve having an operating member that is exposed to the ambient pressure in both material chambers. The operating member will close the inlet port to the material chamber having the highest pressure and open the inlet port to material chamber having the lowest pressure to allow material to be pumped to the low pressure material chamber. The material discharge port has an alternating discharge valve with an operating member that is also exposed to the ambient pressure in both material chambers. The operating member of the alternating discharge valve will close the discharge port to the chamber having the lowest pressure and open the discharge port to the chamber with the highest pressure to discharge material from the chamer having the highest pressure. With this arrangement, sticking valves have a better chance of being loosened since they are exposed both to the elevated pressure in one material chamber and the reduced pressure in the other material chamber. Further the elimination of mechanical actuation of the inlet and discharge valves assists in eliminating the potential for sticking valves.

DETAILED DESCRIPTION OF THE PREFERRED EMBODIMENT

Figure 1:
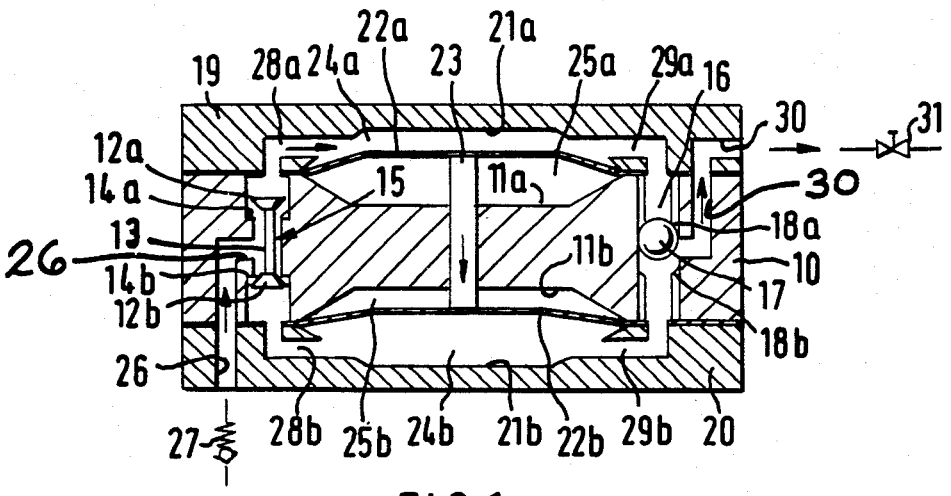
FIG. 1 is a diagrammatic vertical cross-sectional view of the diaphragm pump of the present invention showing the forward stroke.

Referring now to FIG. 1 a diaphragm pump according to the invention is shown. The pump includes a housing or body 10 which is generally disc-shaped. The top and bottom faces of the body 10 define frustoconical recesses 11*a*, 11*b* which have diameters less than the diameter of the body 10.

An alternating inlet valve 15 is located in an inlet port 26 of the body 10. The inlet valve 15 has an upper disc 12*a* and a lower disc 12*b* interconnected by a stem 13. The upper disc 12*a* seals against an upper seat 14*a* and the lower disc 12*b* alternately seals against a lower seat 14*b*. A discharge valve 16 is located in the discharge port of the body 10. The valve 16 includes a ball 17 that alternately seals against an upper seat 18*a* and a lower seat 18*b*.

An upper cover plate 19 and a lower cover plate 20 are secured to the body 10 to form a fluid tight seal over the recesses 11*a*, 11*b*. The upper cover plate 19 and lower cover plate 20 define recesses 21*a* and 21*b* which are opposed to the recesses 11*a* and 11*b* of the body 10. A flexible diaphragm membrane 22*a* is operatively fixed between the cover plate 19 and the body 10. Similarly, a second flexible diaphragm membrane 22*b* is operatively secured between the cover plate 20 and the body 10. The two diaphragm members 22*a*, 22*b* are interconnected at their centers by a rod or bolt 23 that passes through a cylindrical bearing in the body 10.

Defined between cover plate 19 and diaphragm 22*a* is a first material chamber 24*a*. Defined between cover plate 20 and diaphragm 22*b* is a second material chamber 24*b*. The material chambers 24*a*, 24*b*, receive the material to be pumped through inlet passages 28*a*, 28*b* respectively. The material chambers 24*a*, 24*b* similarly discharge the material that is to be pumped through discharge passages 29*a* and 29*b* respectively.

Defined between diaphragm 22*a* and the recess 11*a* in the body 10 is a fluid chamber 25*a*. Defined between diaphragm 22b and the recess 11b in the body 10 is a second fluid chamber 25b. The fluid chambers 25a, 25b receive the working fluid from a separate supply source (not shown) to operate the material chambers 24a and 24b to pump the material. It is understood that the positioning of the material chambers and fluid chambers may be changed in other embodiments and still be within the scope of the present invention.

Figure 2:
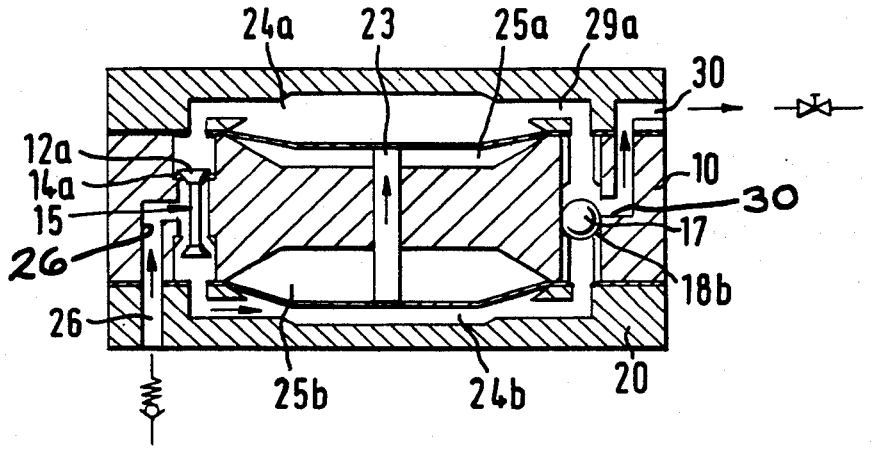
FIG. 2 is a diagrammatic vertical cross-sectional view of the diaphragm pump of FIG. 1, showing a return stroke.

Referring now to FIGS. 1 and 2, the cycle of operation of the improved diaphragm pump will be described. The chamber 25b receives a supply of working fluid, usually compressed air, from a working fluid supply source and moves from a position adjacent the recess 11b to a position adjacent the recess 21b. As the diaphragm 22b moves, it pulls the diaphragm 22a with it because they are interconnected by the bolt 23. The movement of the diaphragm 22a toward the recess 11a and away from the recess 21a causes working fluid to be discharged from the chamber 25a. As will be described below, a portion of the working fluid discharging from chamber 25a is used to initiate expansion of or pre-pressurize the chamber 25b. As the chamber 25a discharges working fluid and the chamber 25b pressurizes with working fluid, it can be seen that the pressure in the material chamber 24b is increased while the pressure in the material chamber 24a is reduced. The high pressure in material chamber 24b and concomitant low pressure in the material chamer 24a causes the disc 12b of the inlet valve 15 to seal against the seat 14b allowing the material to be pumped to flow through the inlet passage 28a into the material chamber 24a. Simultaneously the ball member 17 of the discharge valve 16 closes against seat 18a so that the pumped material flows from material chamber 24b through the discharge passage 29b and out through the discharge port 30.

When the diaphragm 22a contacts the surface of the recess 11a, the pump stroke will be reversed as will be more fully described below. Upon stroke reversal, working fluid is supplied to the fluid chamber 25a and is discharged from fluid chamber 25b. The diaphragm 22a then moves in a direction away from the recess 11a and toward the recess 21a as the chamber 25a expands. The diaphragm 22b moves in the same direction as the diaphragm 22a because of the rigid interconnectiion by the bolt 23. As the diaphragms 22a, 22b move, the pressure in the material chamber 24a will increase and the pressure in the material chamber 24b will decrease. Referring to FIG. 2, the high pressure in the material chamber 24a and the concomitant low pressure in the material chamber 24b will shift the valve 15 so that the disc 12a seals against the seat 14a allowing material to flow through the inlet port 26 and the inlet passage 28b into the material chamber 24b. Likewise, the ball 17 of the discharge valve 16 will seal upon the seat 18b and the material will be pumped from the 24a through the discharge passage 29a to the discharge port 30. As the diaphragm 22b reaches the surface of the recess 11b, stroke reversal will again take place and the sequence of operations described with reference to FIG. 1 will be repeated.

Figure 3:
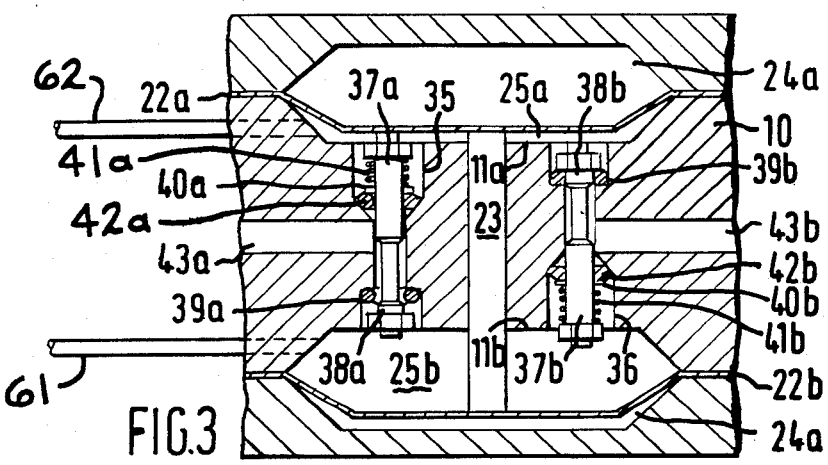
FIGS. 3, 4 and 5 are enlarged cross-sectional views of the diaphragm pump of the present invention showing the operation of the pilot valves.
Figure 4:
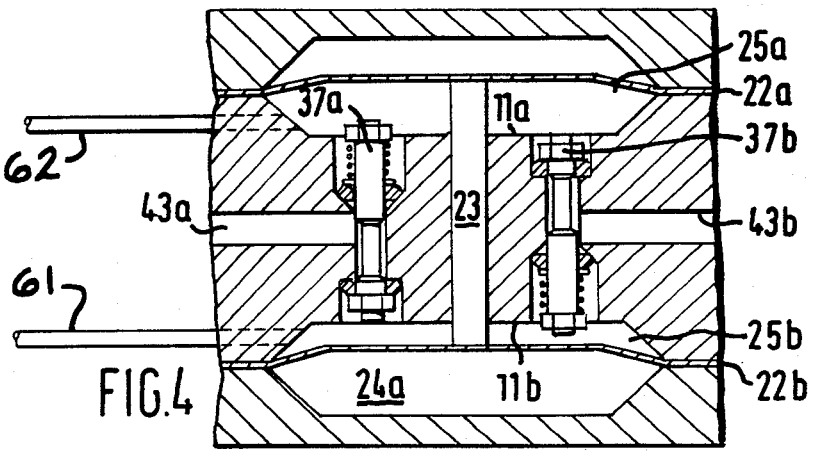
Figure 5:
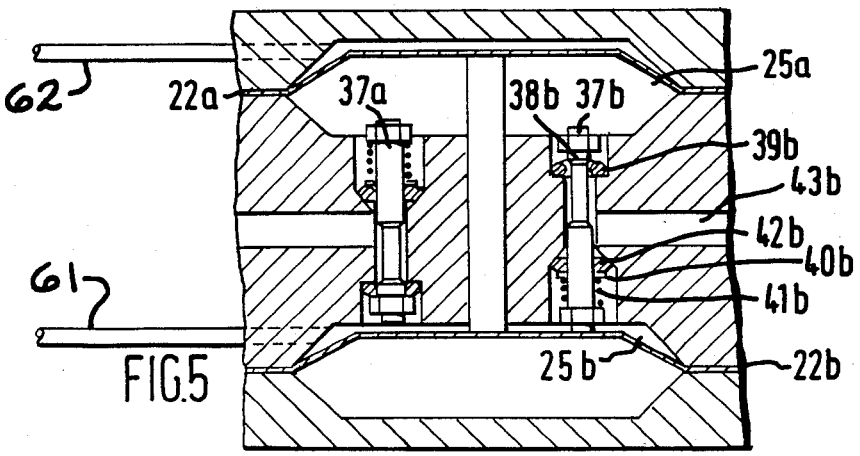

Referring now to FIGS. 3, 4 and 5, the reversal system of the present invention will be described. The housing 10 is formed having a pair of bores 35, 36 positioned between and communicating with fluid chambers 25a, 25b. Positioned in bore 35 is pilot valve 37a and positioned in bore 36 is pilot valve 37b. One end of each pilot valve has a plug valve comprising a collar 38a, 38b and an O-ring 39a, 39b. When the pilot valve 37a, 37b is in normal position, the collar 38a, 38b seals against O-ring 39a, 39b. Adjacent the opposed end of the pilot valve 37a, 37b is a washer check valve comprising a 40a, 40b and an O-ring 42a 42b. When the pilot valve 37a, 37b is in its normal position, the washer 40a, 40b is loaded by a spring 41a, 41b to seal against O-ring 42a, 42b.

In FIG. 3, the pressurized working fluid contained in the fluid chamber 25b has pushed the diaphragm 22b to a position immediately adjacent the recess 21b. Because the diaphragm 22b is rigidly connected to the diaphragm 22a, the diaphragm 22a has also moved to a position immediately adjacent the recess 11a and the chamber 25a is exhausted of working fluid. Referring now to FIG. 4, the end of the pilot valve 37a, which is opposed to the collar 38a, extends slightly above the surface of the recess 11a into the fluid chamber 25a. Referring to FIG. 3, the diaphragm 22a will engage the end of the pilot valve 37a extending above the surface of the recess 11a as the working fluid from the chamber 25a is completely exhausted. This contact between the diaphragm 22a and the end of the pilot valve 37a pushes the pilot valve 37a towards the fluid chamber 25b, thereby disengaging the collar 38a from the O-ring 39a. As the plug valve collar 38a is disengaged from the O-ring 39a, the seal is broken and working fluid under pressure will flow from the chamber 25b to a pilot conduit 43a in a burst of pilot fluid which initiates partial actuation of a control valve 45 to initiate the reversal of the stroke of the pump. The action of the control valve 45 will be described in greater detail below. Concurrently, the working fluid under pressure flowing from the chamber 25b will exert pressure on the check valve O-ring 42a and the washer 40a to compress the spring 41a and break the seal between the washer 40a and the O-ring 42a. As the seal between the washer 40a and the O-ring 42a is broken the high pressure working fluid in the chamber 25b will flow into the chamber 25a to pre-pressurize and initiate expansion of the chamber 25a.

As the pressurized working fluid flows from the chamber 25b into chamber 25a, the diaphragm 22a will move in a direction toward the recess 21a and away from the recess 11a. The movement of the diaphragm 22a will cause the diaphragm 22b to move in a direction towards the recess 11b and away from the recess 21b, thereby discharging working fluid from the chamber 25b. As the diaphragm 22a moves toward the recess 21a, the material contained in the material chamber 24a will flow through the discharge passage 29a, past the ball 17, into the discharge port 30. As the diaphragm 22a moves away from the surface 11a, it will also disengage the pilot valve 37a. The tension in the spring 41a and the working fluid pressure building in the chamber 25a will return the pilot valve 37a to its rest state in which the fluid chambers 25a and 25b are sealed by the plug valve and check valve and isolated from one another.

Referring now to FIG. 4, the working condition of the pump with the pressurized working fluid flowing into the chamber 25a and discharging from the chamber 25b is shown. The diaphragm 22a is moving in a direction towards the recess 21a and pulling the diaphragm 22b in a direction towards the recess 11b by the action of the bolt 23. The pilot valves 37a, 37b are both in their rest state in which they seal and isolate the fluid chambers 25a, 25b from one another and from their associated pilot conduits 43a, 43b.

Referring now to FIG. 5, the working condition of the pump is shown having the diaphragm 22*a* immediately adjacent the recess 21*a* and the diaphragm 22*b* immediately adjacent the recess 11*b*. As shown in FIG. 4, the end of the pilot valve 37*b* which is opposed to the plug valve collar 38*b* projects slightly above the surface of the recess 11*b* into the chamber 25*b*. Referring back to FIG. 5, the diaphragm 22*b* engages the end of the pilot valve 37*b* causing the collar 38*b* to disengage from the O-ring 39*b*. As the collar 38*b* disengages from the O-ring 39*b* the seal of the plug valve is broken and a burst of pilot fluid flows through the pilot conduit 43*b* to partially initiate the actuation of the control valve 45 and begin the reversal of the pump. The operation of the control valve will be described in greater detail below.

Pressurized working fluid contained in the fluid chamber 25*a* also presses against the check valve O-ring 42*b* and the washer 40*b* to compress the spring 41*b*. As the spring 41*b* compresses, the seal between the washer 40*b* and the O-ring 42*b* is broken and working fluid under pressure briefly flows from the chamber 25*a* into the chamber 25*b* to initiate expansion of chamber 25*b*. The reversed working fluid flows to the diaphragm 22*b* and pushes the diaphragm 22*b* toward the recess 21*b* and away from recess 11*b*, thereby pumping material out of the material chamber 24*b*; through discharge passage 29*b*; past the ball 17; and into the discharge port 30. As the diaphragm 22*b* moves toward the recess 21*b*, the diaphragm 22*b* disengages the end of the pilot valve 37*b* and the spring 41*b*, aided by the effects of the increasing pressure in the chamber 25*b*, returns the pilot valve 37*b* to its rest position. This seals and isolates the fluid chambers 25*a* and 25*b* from one another. It will be appreciated that the above pumping sequence can continue indefinitely throughout the pump use.

At the end of each stroke, the pilot valve 37*a* or 37*b* is actuated by direct contact with the respective diaphragm 22*a* or 22*b* and the pilot fluid is taken from the working fluid contained in the respective fluid chamber 25*b* or 25*a* under pressure to initiate actuation of the stroke reversal. Furthermore, at the end of the stroke, the pressurized working fluid contained in the pressurized working chamber expands into the exhausted working chamber. This reuse of a portion of the pressurized working fluid increases the pump efficiency; considerably reduces pulsation of the material being pumped; and reduces the volume of exhaust air thereby combating icing.

Figure 6:
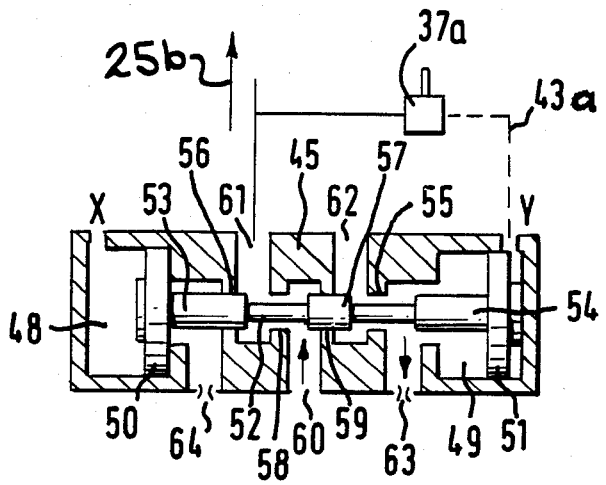
FIGS. 6, 7 and 8 are diagrammatic cross-sectional views showing the operation of the control valve of the present invention.
Figure 7:
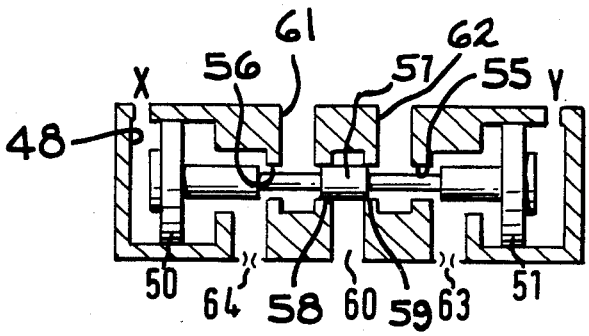
Figure 8:
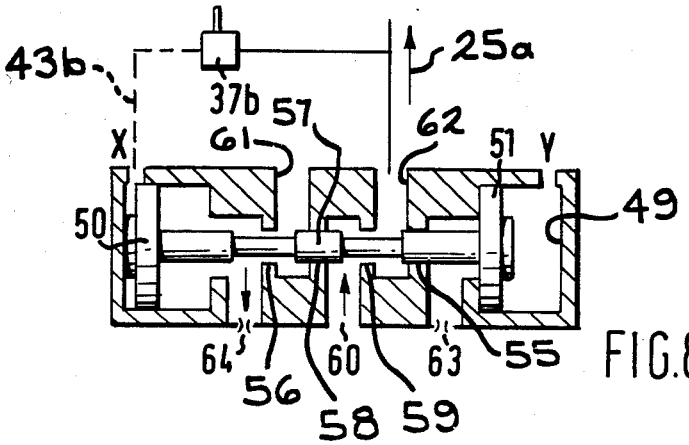

Referring now to FIGS. 6, 7 and 8, the actuation of the control valve 45 will be described. In the preferred embodiment the body of control valve 45 is integral with the housing 10. Formed at the opposed ends of the control valve 45 are cylinders 48, 49. Positioned in the cylinders 48, 49 are pistons 50, 51 which are interconnected by a rod 52. Positioned on the rod 52 immediately adjacent the pistons 50, 51 are valve members 53, 54 which selectively mate with control ports 55, 56 to form a seal. A central valve or plug member 57 is located on the rod 52 halfway between pistons 50, 51. The central plug member 57 mates with control ports 58 and 59 either individually or simultaneously to form a seal.

Referring now to FIG. 6, a working fluid supply port 60 communicates through the control port 58 and a port 61 with the fluid chamber 25*b*. The working fluid supply port 60 also communicates through the control port 58 and the port 61 through the pilot conduit 43*a* and port Y with the piston 51 side of the cylinder 49. Working fluid discharges from the fluid chamber 25*a* through a port 62 and the control port 55 to exhaust port 63. The brief actuation of the pilot valve 37*a* by the diaphragm 22*a* will deliver a burst of pilot fluid from the fluid chamber 25*b* to the piston 51 driving the piston 51 to the left (as shown in FIGS. 6 and 7) until the piston 51 reaches the position shown in FIG. 7.

Referring now to FIG. 7, the pressurized working fluid discharging from the fluid chamber 25*b* through the port 61 exerts pressure against the rod side of piston 50 in the cylinder 48 through the control port 56. The pressurized working fluid received in the cylinder 48 drives the interconnected pistons 50, 51 to the left-hand limit of their travel as shown in FIG. 8. In the position shown in FIG. 8, the remaining pressurized working fluid discharging from the fluid chamber 25*b* will flow through the port 61 and the control port 56 to an exhaust port 64 until the chamber 25*b* is exhausted of working fluid. The working fluid supply port 60 is now connected through the control port 59 with port 62 to supply working fluid under pressure into the chamber 25*a*. As the fluid chamber 25*a* expands with working fluid, the diaphragm 22*b* will be pulled by diaphragm 22*a* into engagement with the end of the pilot valve 37*b*. As the diaphragm 22*b* presses against the pilot valve 37*b*, the pilot valve 37*b* is actuated to supply a burst of pilot fluid through the pilot conduit 43*b* and a port X to the piston 50 side of the cylinder 48. The burst of pilot fluid drives the interconnected pistons 50, 51 to the right to the position shown in FIG. 7. As pressurized working fluid discharges from the chamber 25*a* through port 62 and the control port 55 to the rod side of the cylinder 49, the interconnected pistons 50, 51 are driven to the right-hand limit of their travel (i.e. back to the FIG. 6 position). It will be appreciated that this sequence can go on indefinitely during the pump operation.

The control valve 45 in combined action with the pilot valves 37*a*, 37*b* exhibits significant advantages for a diaphragm pump. Actuation of the control valve 45 is initiated by a burst of pilot fluid received from the pressurized fluid chamber 25*a* or 25*b*. Once stroke reversal has begun, pressurized fluid exhausting from the chamber 25*a* or 25*b* causes the control valve to rapidly complete the stroke reversal. Reversal from the forward stroke to the return stroke is, therefore, extremely rapid, effectively reducing material pulsation. Furthermore, a portion of the discharged air from the pressurized fluid chamber 25*a* or 25*b* is reused to pre-pressurize and initiate expansion of the exhausted fluid chamber 25*b*, 25*a*. The remainder of the discharged air exhausting from the pressurized air chamber 25*a*, 25*b* is pre-expanded in the control valve 45 and then discharged through exhaust ports 63, 64. This expansion of the remaining discharged fluid reduces potential icing and the noise level of the pump during operation.

Figure 9:
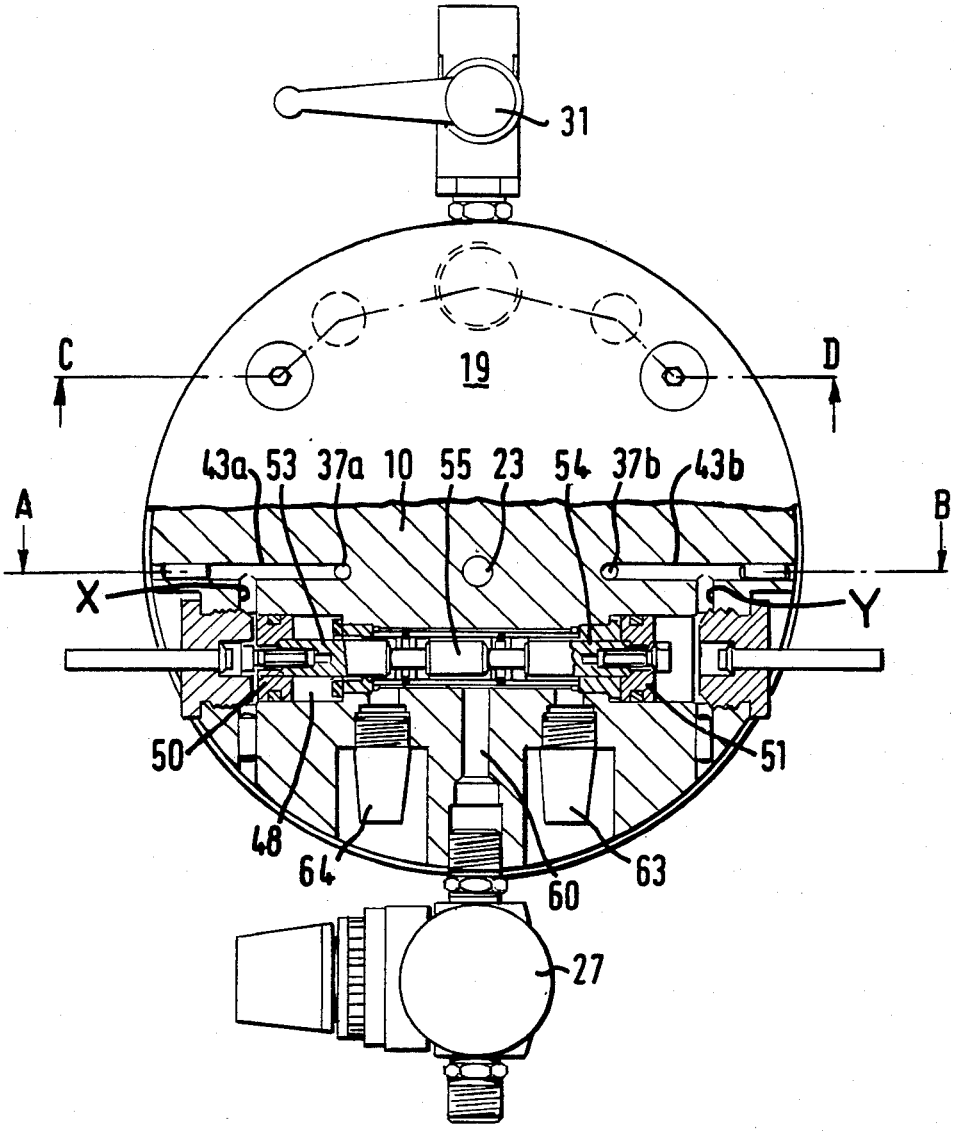
FIG. 9 shows a plan view of the diaphragm pump of the present invention with a portion cutaway to show the internal mechanisms.
Figure 10:
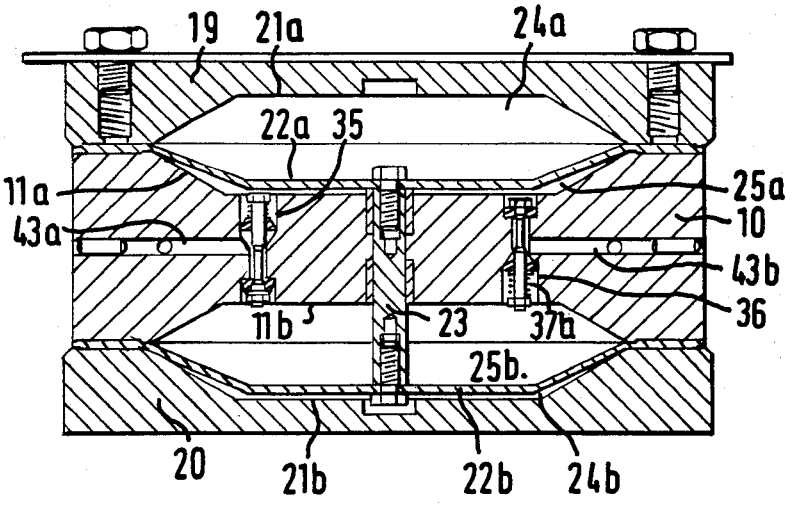
FIG. 10 is a sectional view taken along line A-B of FIG. 9.
Figure 11:
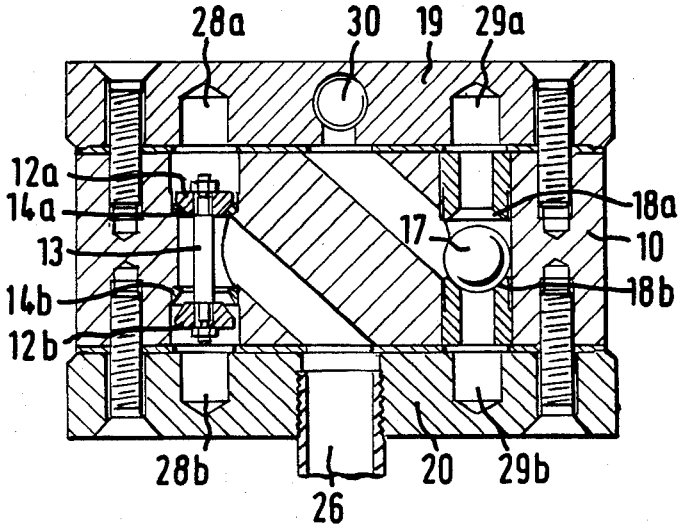
FIG. 11 is a sectional view taken along line C-D of FIG. 9.

An embodiment of a diaphragm pump according to the present invention is shown in further detail in FIGS. 9, 10 and 11. The above-described elements severally illustrated in the previous figures are identified by the same reference numerals and combined within a single housing.

What I claim is:

1. An improved diaphragm pump comprising:

a housing having a material inlet port and a material discharge port, said housing defining a first chamber and second chamber; a first diaphragm means fixed within said first chamber to define a first fluid chamber and a first material chamber, said material chamber being in communication with said material inlet port and said material discharge port and a second diaphragm means fixed within said second chamber to define a second fluid chamber and a second material chamber, said second material chamber being in communication with said material inlet port and said material discharge port, said first diaphragm means and said second diaphragm means operatively interconnected to alternate between a forward stroke in which working fluid supplied under pressure from a working fluid source is admitted to said first fluid chamber to pump material contained in said first material chamber through said material discharge port and working fluid is discharged from said second fluid chamber to draw material to be pumped through said material inlet port into said second material chamber and a return stroke in which the working fluid is supplied under pressure to said second fluid chamber to pump material contained in said second material chamber through said material discharge port and working fluid is discharged from said first fluid chamber to draw material through said material inlet port into said first material chamber; a first pilot valve in said housing positioned between and in communication with said first fluid chamber and said second fluid chamber and a second pilot valve in said housing positioned between and in communication with said first fluid chamber and said second fluid chamber, said first and second pilot valves being in a normally closed state and positioned for engagement by said first and second diaphragm means respectively, said first diaphragm means engaging and actuating said first pilot valve when the working fluid is exhausted from said first fluid chamber, said first pilot valve opening upon engagement by said first diaphragm and directing a portion of the working fluid contained under pressure in said second fluid chamber into said first fluid chamber to initiate expansion of said first fluid chamber, said second diaphragm means engaging and actuating said second pilot valve when the working fluid is exhausted from said second fluid chamber, said second pilot valve opening upon engagement by said second diaphragm and directing a portion of such working fluid contained under pressure in said first fluid chamber into said second fluid chamber to initiate expansion of said second fluid chamber; and a control valve means for reversing the stroke of said pump, said control valve means being adapted to receive and exhaust the working fluid under pressure.

2. The improved diaphragm pump of claim 1 wherein said housing includes a first passageway positioned between and in communication with said first and second fluid chambers and a second passageway positioned between and in communication with said first and second fluid chamber, said first pilot valve being positioned in said first passageway and said second pilot valve being positioned in said second passageway, said first pilot valve including a first plug valve that normally seals said second fluid chamber from said first passageway and a first check valve that normally seals said first fluid chamber from said first passageway, said first plug valve being displaced to an open position when said first diaphragm means engages said first pilot valve directing working fluid under pressure from said second fluid chamber through said first passageway to said first check valve, said first check valve opening to direct the working fluid under pressure from said second fluid chamber to said first fluid chamber, said second pilot valve incuding a second plug valve that normally seals said first fluid chamber from said second passageway and a second check valve that normally seals said second fluid chamber from said second passageway, said second plug valve being displaced to an open position when said second diaphragm means engages said second pilot valve directing working fluid under pressure from said first fluid chamber through said second passageway to said second check valve, said second check valve opening to direct the working fluid under pressure from said first fluid chamber to said second fluid chamber.

3. The improved diaphragm pump of claim 2, wherein said control valve is in communication with said first fluid chamber, said second fluid chamber, said first pilot valve and said second pilot valve, said control valve including means for receiving a burst of working fluid from said first pilot valve as said first pilot valve is actuated by said first diaphragm means said control valve being partially actuated by such burst of working fluid to receive additional working fluid under pressure from said second fluid chamber, the working fluid received by said control valve from said second fluid chamber completing the actuation of said control valve, wherein said control valve further includes means for receiving a burst of working fluid from said second pilot valve as said second pilot valve is actuated by said second diaphragm means and control valve being partially actuated by the burst of working fluid to receive additional working fluid under pressure from said first fluid chamber, the working fluid received by said control valve from said first fluid chamber completing the actuation of said control valve.

4. The improved diaphragm pump of claim 3, wherein said control valve includes plug means for alternating the working fluid received from the working fluid source to either said first fluid chamber or said second fluid chamber.

5. The improved diaphragm pump of claim 4, wherein said control valve includes a first cylinder and an opposed second cylinder, a first piston positioned in said first cylinder and a second piston positioned in said second cylinder, said first and second pistions being operatively connected by a rod, said rod having said plug means positioned between said first piston and said second piston, said control valve further including a first control port in communication with the working fluid supply source and said first fluid chamber and a second control port in communication with the working fluid supply source and said second fluid chamber whereby said plug means is selectively displaceable to mate with said first control port and said second control port as said first and second interconnected pistons move in said first and second cylinder to direct the working fluid from the working fluid source into either said first fluid chamber or said second fluid chamber.

6. The improved diaphragm pump of claim 5, wherein said first cylinder of said control valve is in communication with said first pilot valve and said first cylinder receives the burst of working fluid from said first pilot valve, said interconnected first and second pistons being moveable from a first portion to second position to initiate the stroke reversal of said pump, said second cylinder receiving the working fluid being discharged from said second fluid chamber and said interconnected first and second pistons being driven by the working fluid from the second position to a third position to complete the stroke reversal of said pump, said second cylinder of said control valve being in communication with said second pilot valve and said second cylinder receiving the burst of working fluid from said second pilot valve, said interconnected first and second pistons being moved from the third position to the second position to initiate another stroke reversal, said first cylinder receiving the working fluid being discharged from said first fluid chamber, said interconnected first and second pistons being driven by the working fluid from the second position back to the first position to complete the stroke cycle of said pump.

7. The diaphragm pump of claim 1, wherein said material inlet port includes an alternating inlet valve, said alternating inlet valve being exposed to the pressure in said first material chamber and the pressure in said second material chamber, whereby said alternating inlet valve closes said inlet port to said material chamber having the highest pressure and opens said inlet port to said material chamber having the lowest pressure.

8. The improved diaphragm pump of claim 1, wherein said material discharge port includes an alternating discharge valve having an operating member that is exposed to the pressure contained in said first material chamber and the pressure contained in said second material chamber, whereby said alternating discharge valve closes said material discharge port to said material chamber having the lowest pressure and opens said material discharge port to said material chamber having the highest pressure.

9. The improved diaphragm pump of claim 1, wherein said housing includes a body member defining said material inlet port and said material outlet port, a first cover member attached to said body member to define said first chamber between said body member and said first cover member, a second cover member attached to the opposed side of said body member to define said second chamber between said body member and said second cover member, said first diaphragm means being secured in said first chamber between said body member and said first cover member and said second diaphragm means being secured in said second chamber between said body member and said second cover member.

* * * * *